US006874577B2

(12) United States Patent
Abbott et al.

(10) Patent No.: US 6,874,577 B2
(45) **Date of Patent: *Apr. 5, 2005**

(54) WATER, OIL AND GAS WELL RECOVERY SYSTEM

(75) Inventors: Douglas H. Abbott, Medicine Hat (CA); Daniel S. Belczewski, Calgary (CA)

(73) Assignee: McKinley Harrison Keyco, Medicine Hat (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/661,215

(22) Filed: Sep. 12, 2003

(65) Prior Publication Data

US 2004/0035571 A1 Feb. 26, 2004

Related U.S. Application Data

(63) Continuation of application No. 10/057,727, filed on Jan. 25, 2002, now Pat. No. 6,644,399.

(51) Int. Cl.[7] ..... E21B 34/06

(52) U.S. Cl. ..... 166/106; 166/53; 166/68; 166/101; 166/332.1

(58) Field of Search ..... 166/53, 68, 101, 166/105.1, 106, 191, 202, 332.1

(56) References Cited

U.S. PATENT DOCUMENTS 4,239,458 A * 12/1980 Yeatts ..... 417/60
5,253,713 A 10/1993 Gregg et al.
5,494,109 A 2/1996 Schmitt
6,148,923 A 11/2000 Casey
6,644,399 B2 * 11/2003 Abbott et al. ..... 166/68

* cited by examiner

*Primary Examiner*—Zakiya Walker
(74) *Attorney, Agent, or Firm*—Swanson & Bratschun, LLC

(57) ABSTRACT

An auto-cycling plunger including a hollow, longitudinally extending body, at least one first directional outer seal, at least one second directional outer seal and a valve stem. Both the at least one first directional outer seal and the at least one second directional outer seal are disposed on an exterior surface of the body for creating a seal between the body and a well bore. Portions of the seals extend in a direction substantially parallel to the length of the longitudinally extending body such that these portions are spread resiliently outwardly from the body with an applied pressure, thereby increasing the degree of sealing. The first directional outer seal extending in a direction substantially opposite to the direction of the at least one second directional outer seal. The valve stem includes a valve member, extends through the longitudinally extending body, and has actual ends extending from the body. The valve stem is operable to be shuttled between an open and a closed position. When the valve stem is in the open position, the valve member is longitudinally spaced from a valve seat on the body to allow fluid flow through the length of the body and when the valve stem is in the closed position, the valve member is seated on the valve seat, thereby sealing the body and preventing fluid flow therethrough.

10 Claims, 5 Drawing Sheets

54
48
28
52
46
74
76
40
78
36
34
44
42
54
30
86
88
31
82
32
84
80
64
60
62
38
66
56
60
24
50
26

WATER, OIL AND GAS WELL RECOVERY SYSTEM

RELATED APPLICATION DATA

This application is a continuation of commonly assigned U.S. application Ser. No. 10/057,727, filed Jan. 25, 2002, now U.S. Pat. No. 6,644,399. issued Nov. 11, 2003. entitled WATER, OIL AND GAS WELL RECOVERY SYSTEM, which patent is incorporated by reference herein in its entirety.

FIELD OF THE INVENTION

This invention relates to pump systems for use in oil, gas or water wells and more particularly to an auto-cycling plunger for delivery of a fluid to the top of a well bore.

BACKGROUND OF THE INVENTION

Conventional pump systems for delivery of a fluid from a well bore include pump jacks or positive cavity pumps. While these pump systems have achieved extensive use, they suffer from many disadvantages. One disadvantage is that these systems are expensive. This is particularly problematic for wells with low delivery rates as the cost of the equipment may be difficult to justify. Further, these systems require the use of external power or fuel for use, which requires that power, or fuel be delivered to the well site. Again, the cost of providing power to a well having low delivery rate may be difficult to justify, particularly in remote well locations.

In order to overcome these problems, plunger lift systems have been employed for the delivery of fluid from a well head using pressure from the well. The fluid can include, for example, crude oil or gas. A typical plunger in use in a well bore has fluid above, which is being lifted from the well bore, and gas and fluid below, which is providing the pressure for lifting the plunger. Early plunger lift systems include solid rods without any sealing mechanism. The solid rod includes grooves that cause turbulence as gas passes the plunger in the well bore, which aids in lifting the plunger in the bore. These systems are not efficient, however, as they are prone to fluid and gas leakage past the plunger when in use. Escape of gas or fluid past the plunger causes a loss of gas and fluid pressure from below the tool which results in slower delivery of fluid to the top of the well bore.

Many variations to the plunger lift system have been proposed in an attempt to overcome these problems. For example, U.S. Pat. No. 6,148,923 to Casey, issued Nov. 21, 2000, teaches a plunger mechanism with a generally cylindrical body with an internal valve member and external seals. This plunger includes a tube, a detachable valve member that sits in the lower section of the tube and flapper sealing rings mounted along the tube. This plunger is allowed to fall down a well bore, the detachable valve member separates from the cylindrical body and falls independently through the well casing. Liquid passes through the center of the cylindrical body as the body falls. The detachable valve member strikes a stop in the well casing and the cylindrical body follows such that the valve member engages in the cylindrical body and forms a seal therein. Therefore, the liquid below the plunger is sealed from the liquid above the plunger and the plunger rises as a result of the pressure below.

The system disclosed by Casey suffers many disadvantages. This system is intended for use with a spring in the well bore for landing and cushioning of the auto cycle plunger. This spring can break down into pieces that can lodge in valves, flow lines or in the well bore and regular maintenance to avoid these problems can be costly. Also, the valve disclosed by Casey may not function well in certain environments. Without the use of a spring, for example, the ball may become lodged in sand or mud in the bottom of a well bore which may inhibit entry into the body of the plunger and prevent sealing. Furthermore, the flapper sealing rings are all urged in the downward direction as the plunger travels upwardly. When the head pressure rises above a critical pressure, the flapper sealing rings are not able to maintain a seal and fluid can escape past these sealing rings. Thus, the system disclosed by Casey is not effective in maintaining a seal below a perforation in a well bore. When the plunger is below a perforation, fluid pressure at the perforation acts downwardly on the plunger. If this pressure is too high, the sealing rings will not maintain a seal. Therefore this plunger is not effective in maintaining seal in a multiple perforated well bore (with more than one perforation in the well casing for fluid ingress into the well bore).

Accordingly, it is an object of the present invention to provide a plunger for delivery of fluid to the top of a well bore that obviates or mitigates at least some of the disadvantages of the prior art.

SUMMARY OF THE INVENTION

In accordance with an aspect of the present invention, there is provided an auto-cycling plunger for use in lifting a fluid out of a well bore. The auto-cycling plunger includes a hollow, longitudinally extending body and at least one first directional outer seal disposed on an exterior surface of the body for creating a seal between the body and a well bore. At least a portion of the at least one first directional outer seal extends in a direction substantially parallel to a length of the longitudinally extending body. The portion of the first directional outer seal is spread resiliently outwardly from the body with an applied pressure, thereby increasing the degree of sealing. The auto-cycling plunger also includes a valve stem which includes a valve member, the valve stem extending through the longitudinally extending body and has spaced apart actuable ends extending from the body. The valve stem is operable to be shuttled between an open position and a closed position. When the valve stem is in the open position, the valve member is longitudinally spaced from a valve seat on the body to allow fluid flow through the length of the body. When the valve stem is in the closed position, the valve member is seated on the valve seat, thereby sealing the body and preventing fluid flow therethrough.

In accordance with another aspect of the present invention, in an auto cycling plunger, there is provided at least one first directional outer seal disposed on an exterior surface of a longitudinally extending body of the plunger for creating a seal between the body and a well bore. At least a portion of the at least one first directional outer seal extends in a direction substantially parallel to a length of the longitudinally extending body. The portion of the first directional outer seal is spread resiliently outwardly from the body with an applied pressure, thereby increasing the degree of sealing. At least one second directional outer seal is disposed on the exterior surface of the body for creating a seal between the body and the well bore. At least a portion of the at least one second directional outer seal extends in a direction substantially parallel to the length of said longitudinally extending body and substantially opposite to the direction of said at least one first directional outer seal. The portion of the second directional outer seal is spread resiliently outwardly from the body with a second applied pressure thereby increasing the degree of sealing;

Advantageously, an aspect of the present invention includes a valve member that comprises a spherical neoprene ball for striking a bottom of a well bore. Thus, no spring is required in the well bore bottom. Also, the present invention provides superior external seals for sealing the fluid below the pump from the fluid above the pump.

BRIEF DESCRIPTION OF THE DRAWINGS

Preferred embodiments of the invention are shown in the drawings wherein.

DETAILED DESCRIPTION OF PREFERRED EMBODIMENTS

Figure 1:
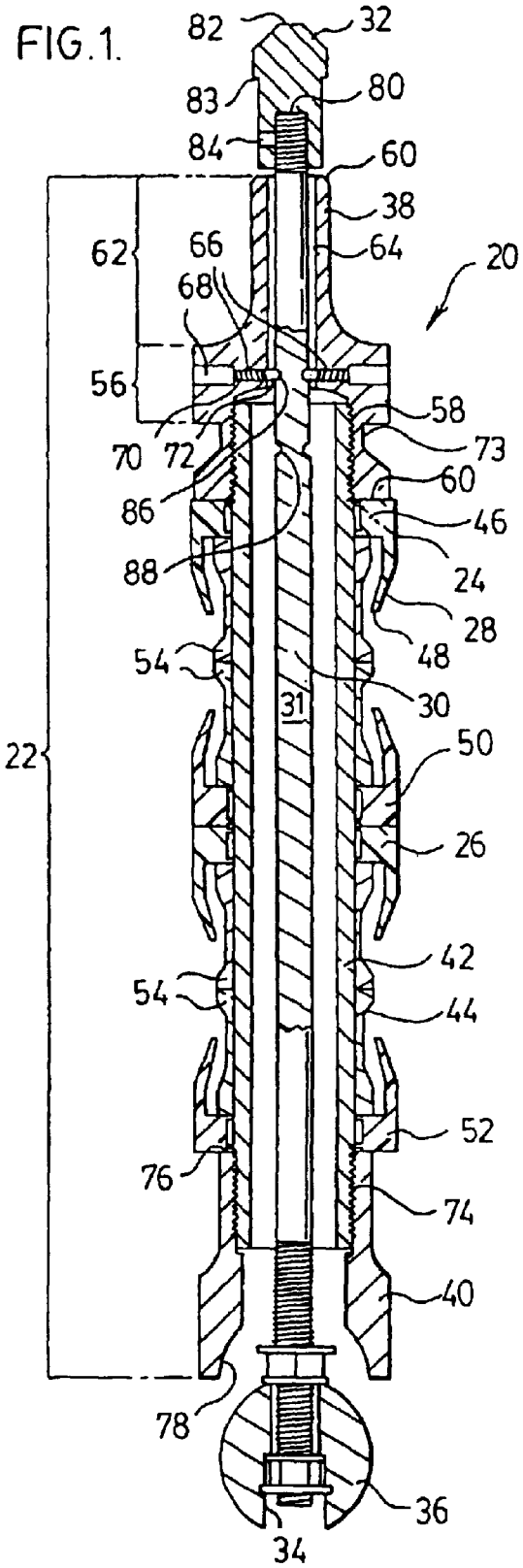
FIG. 1 is a sectional side view of an auto-cycling plunger according to a preferred embodiment of the invention, shown with an internal valve in an open position.
Figure 2:
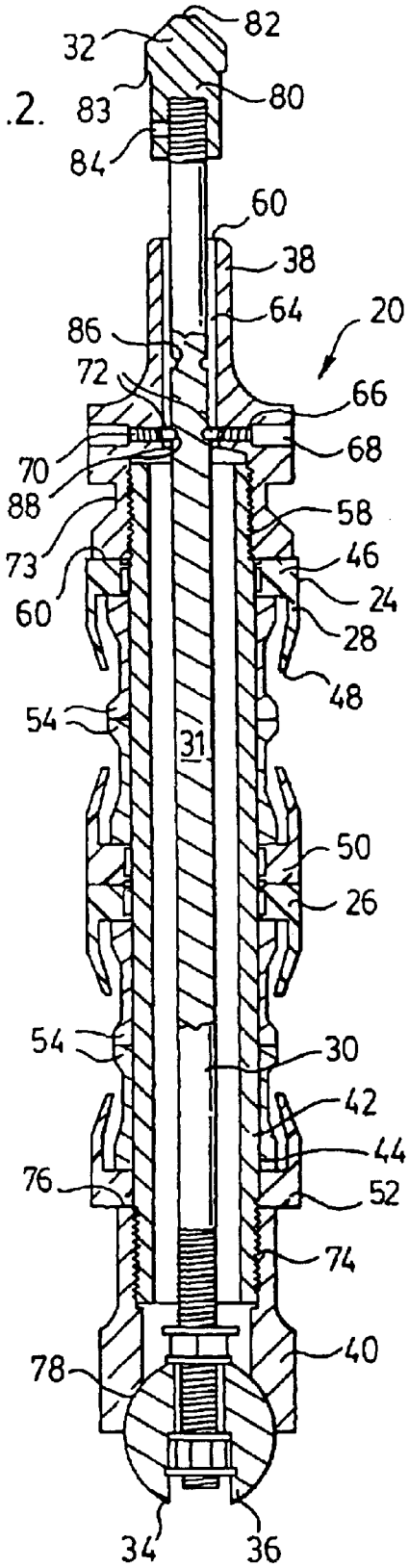
FIG. 2 is a sectional side view of the auto-cycling plunger of FIG. 1 shown with the internal valve in a closed position.

Reference is first made to FIGS. 1 and 2 to describe a preferred embodiment of an auto-cycling plunger designated generally by the numeral 20. The plunger 20 includes a hollow, longitudinally extending body 22. At least one first directional outer seal 24 is disposed on an exterior surface of the body 22 for creating a seal between the body 22 and a well bore (not shown). At least a portion 28 of the at least one first directional outer seal 24 extends in a direction substantially parallel to the length of the longitudinally extending body 22. The portion 28 is spread resiliently outwardly from the body 22 with an applied pressure, thereby increasing the degree of sealing. The auto-cycling plunger 20 also includes a valve stem 30 including a member 36. The valve stem 30 extends through the longitudinally extending body 22 and has actuable ends 32, 34 extending from the body 22. The valve stem 30 is operable to be shuttled between an open position and a closed position. When the valve stem 30 is in the open position, shown in FIG. 1, the valve member 36 is longitudinally spaced from a valve seat 78 on the body 22 to allow fluid flow through the length of the body 22. When the valve stem 30 is in the closed position, the valve member 36 is seated on the valve seat 78, thereby sealing the body 22 and preventing fluid flow therethrough.

Referring to FIGS. 1 and 2, the auto-cycling plunger 20 consists of the body 22 and the valve stem 30. The body 22 includes a first end 38, a second end 40 and a middle portion 42. The middle portion 42 is a hollow tubular section with externally threaded ends for threaded engagement with the first end 38 and the second end 40.

Two first directional outer seals 24, 26 are annularly disposed on the exterior surface 44 of the tubular middle portion 42. As shown in the Figures, one first directional outer seal 24 is located proximal the first end 38 while the first directional outer seal 26 is located near the center of the tubular middle portion 42. Preferably, the two first directional outer seals 24, 26 are urethane seals but other suitable materials can be used.

Each of the first directional outer seals 24, 26 includes a generally cylindrical body portion 46 in sealing contact with the exterior surface 44 of the middle portion 42 and a flange portion, referred to herein above as portion 28. Thus, the body portion 46 extends radially outwardly from the middle portion 42 of the body 22. The flange portion 28 extends from the body portion 46, approximately 90 degrees from the radial direction of the body portion 46. Therefore, the flange portion 28 extends in a direction that is substantially parallel to the direction of the length of the longitudinally extending body 22. A free end 48 of the flange portion 28 tapers inwardly toward the tubular middle portion 42 of the body 22. In the present embodiment, the body portion 46 and the flange portion 28 are continuous and are resiliently deformable.

Similar to the two first directional outer seals 24, 26, two second directional outer seals 50, 52 are annularly disposed on the exterior surface 44 of the tubular middle portion 42. As shown in FIGS. 1 and 2, one second directional outer seal 50 is located near the center of the tubular middle portion 42 while the other of the second directional outer seals 52 is located proximal the second end 40 of the body 22.

The two second directional outer seals 50, 52 are similar to the two first directional outer seals 24, 26 and thus similar numerals will be used to describe similar parts. Therefore, each of the second directional outer seals 24, 26 includes a generally cylindrical body portion 46 in sealing contact with the exterior surface 44 of the middle portion 42 and a flange portion 28. The body portion 46 extends radially outwardly from the middle portion 42 of the body 22 and the flange portion 28 extends from the body portion 46, approximately 90 degrees from the radial direction of the body portion 46. The flange portion 28 of the second directional outer seals 50, 52 extends in a direction that is substantially parallel to the direction of the length of the longitudinally extending body 22 but substantially opposite to the direction of the flange portion 28 of the first directional outer seals 24, 26. Again, the free end 48 of the flange portion 28 tapers inwardly toward the tubular middle portion 42 of the body 22.

It will now be appreciated that the first directional outer seals 24, 26 are similar to the second directional outer seals 50, 52, however, the pump 20 is assembled such that the flange portion 28 of the second directional outer seals 50, 52 faces the opposite direction as the flange portion 28 of the first directional outer seals 24, 26.

Figure 3:
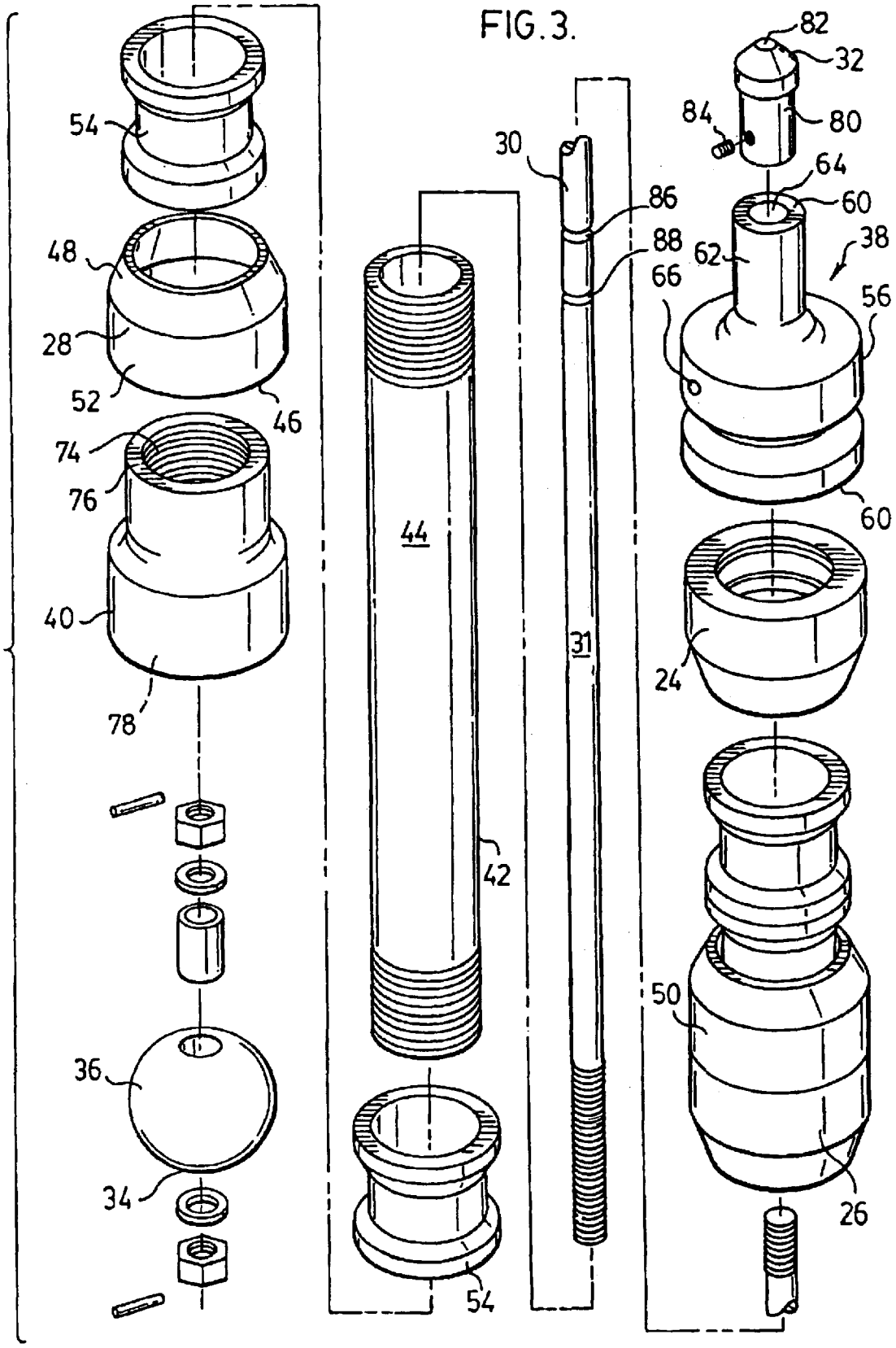
FIG. 3 is an exploded perspective view of the auto-cycling plunger of FIG. 1.

As can be seen in FIGS. 1, 2 and 3, a pair of spacer elements 54 separate the first directional outer seal 24 located proximal the first end 38 from the second directional outer seal 50 located near the center of the tubular middle portion 42. Similarly, a pair of spacer elements 54 separate the first directional outer seal 26 located near the center of the tubular middle portion 42 from the second directional outer seal 52 proximal the second end 40. Each of the spacer elements 54 is annularly disposed around the middle portion 42 for spacing the outer seals 24, 26, 50, 52 and maintaining their respective positions along the middle portion 42. It will be apparent that there is no spacer between the first directional outer seal 26 located near the center of the middle portion 42 and the second directional outer seal 50 located near the center of the middle portion 42. Thus, the first directional outer seal 26 abuts the second directional outer seal 52 and their respective flange portions 28 are directed away from each other.

Referring to FIGS. 1, 2, 3 and 4, the first end 38 of the body 22 has a large diameter section 56 with an internally threaded bore 58 sized for threaded engagement with a threaded end of the middle portion 42. An end wall 60 of the large diameter section 56 abuts an edge of the body portion 46 of the first directional outer seal 24. The first end 38 also has a small diameter section 62 that has a curved taper in the external diameter. The small diameter section 62 also has a cylindrical passage 64 of smaller diameter than the interior diameter of the middle portion 42 of the body 22. The cylindrical passage 64 is sized for clearance fit with the valve stem 30.

Two opposing radial holes 66 are located in the large diameter section 56 of the first end 38. Each of the opposing radial holes 66 is partially threaded and houses a set screw 68 that abuts a coil spring 70. Next each coil spring 70 abuts an obround element 72 that is biased into contact with the valve stem 30 by the coil spring 70 and functions as part of a biased detent system. The function of the biased detent system will be described further below.

The larger diameter section 56 of the first end 38 also has a catch shoulder 73 around the circumference of the large diameter section 56. The catch shoulder 73 is sized and shaped to receive a catch in the well head when the plunger 20 is in the well head, as will be described further below.

Referring still to FIGS. 1 to 4, the second end 40 of the body 22 has an internal bore 74 that is partially threaded and is sized for threaded engagement with one of the threaded ends of the middle portion 42. An end wall 76 of the second end 40 abuts an edge of the body portion 46 of the second directional outer seal 52. On the end opposite the end wall 76, the second end 40 includes a semi-spherical valve seat 78 longitudinally spaced from the threaded portion of the second end 40.

Clearly the second end 40 with the internal bore 74, the tubular middle portion 42 and the first end 38 with the internally threaded bore 58 and cylindrical passage 64 form the continuous hollow body 22. Also, the first and second ends 38, 40 maintain the outer seals 24, 26, 50, 52 and the spacer elements 54 in their respective positions along the middle portion 42 by effectively sandwiching the outer seals 24, 26, 50, 52 and spacer elements 54 therebetween.

The valve stem 30 is cylindrically shaped and includes the first and second actuating ends 32, 34. The valve stem 30 includes a cylindrical rod 31 that is generally centrally located along an axis of the hollow body 22 and extends past both the first and second ends 38, 40 of the body 22. The cylindrical rod 31 is externally threaded at both ends. The actuating end 32 of the valve stem 30 includes an actuating head 80 which is arrow-head like in shape with a truncated tip 82. The arrow-head like shape of the actuating head 80 allows for retrieval of the plunger 20 by hooking on to the shoulder 83 at the tip of the actuating head 80. The actuating head 80 and the shoulder 83 is also referred to as a fish neck. The actuating head 80 includes an internally threaded bore 84 for threaded engagement with one end of the cylindrical rod 31 and is maintained in threaded engagement with the cylindrical rod 31 by a radially located set screw 84 threaded in the head 80 and contacting the rod 31.

Figure 4:
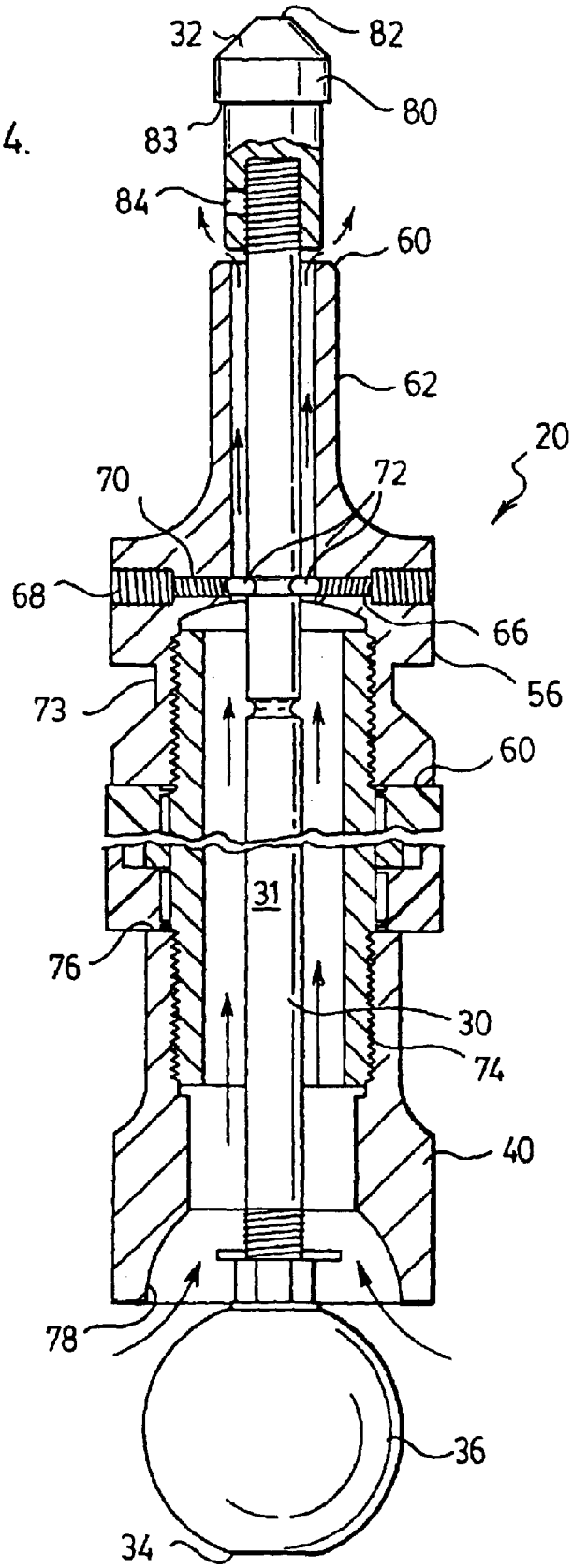
FIG. 4 is a partial sectional side view of the auto-cycling plunger of FIG. 1 drawn to a larger scale

The actuating end 34 of the valve stem 30 includes a spherical ball, referred to above as the valve member 36. The spherical ball 36 is fixed to the end cylindrical rod 31, opposite the end of the rod 31 with the actuating head 80. The spherical ball 36 is preferably made of neoprene and includes a hole passing therethrough. As best shown in FIG. 4, a pair of nuts are threaded onto the rod 31 with the spherical ball 36 being held on the rod 31 by abutment with the nuts. The rod 31 passes through the hole in the spherical ball 36 and at least a portion of the spherical ball 36 is sandwiched between the nuts. The spherical ball 36 is appropriately sized and shaped to be seated on the semi-spherical valve seat 78 of the second end 40 of the body 22.

The cylindrical rod 31 of the valve stem 30 includes a pair of longitudinally spaced annular grooves 86, 88 appropriately sized and shaped to receive the obround locking elements 72. The annular grooves 86, 88 are located on the cylindrical rod 31, at a longitudinal spacing proximal the biased obround elements 72 such that the cylindrical rod 31 can be positioned in the body 22 with the obround locking elements 72 in the annular groove 86 closest to the actuating end 32 or with the obround locking elements 72 in the annular groove 88 closest to the actuating end 34 of the valve stem 30. These positions correspond to the open position shown in FIG. 1, and the closed position shown in FIG. 2. Clearly the spaced annular grooves 86, 88 are part of the biased detent system. The valve stem 30 is thereby releasably indexed in the open and closed positions and can be shuttled therebetween.

When the valve stem 30 is in the open position, with the obround locking elements 72 in the annular groove 86, the spherical ball 36 is longitudinally spaced from the semi-spherical valve seat 78. In this position, fluid can flow through the continuous hollow body 22. Conversely, when the valve stem 30 is in the closed position, with the obround locking elements 72 in the annular groove 88, the spherical ball 36 is seated on the valve seat 78 thereby sealing the continuous hollow body 22.

Figure 5:
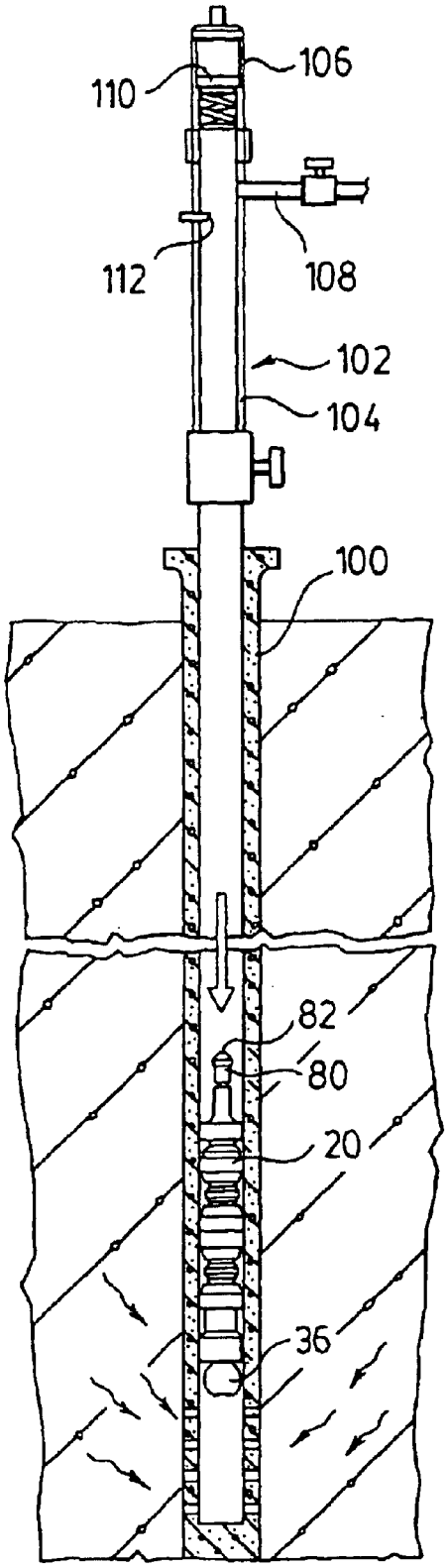
FIG. 5 is a side view of the auto-cycling plunger of FIG. 1 shown with the internal valve in the open position and the auto cycling plunger falling in a well bore shown in section.
Figure 6:
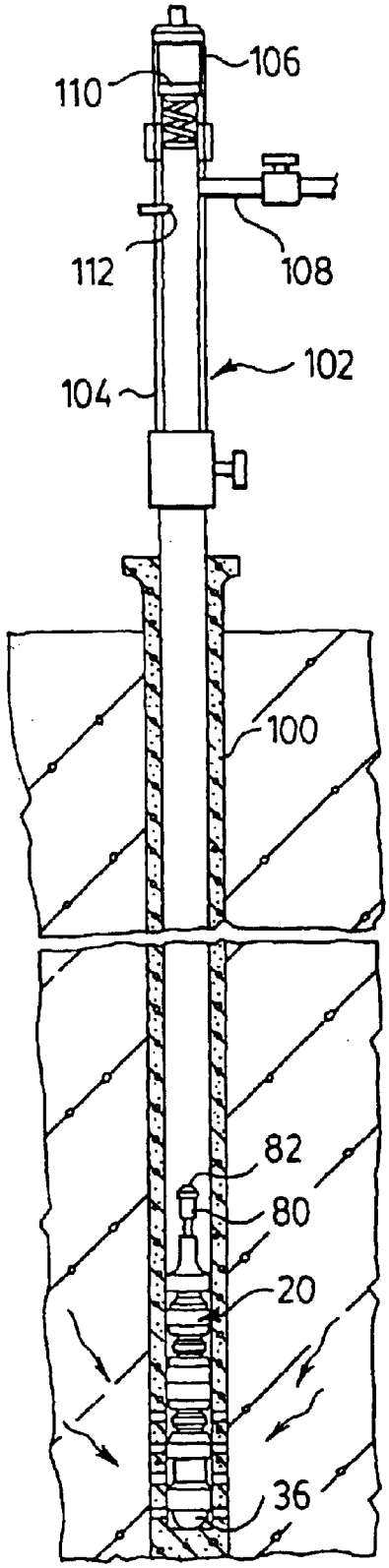
FIG. 6 is a side view of the auto-cycling plunger of FIG. 5 in a bottom of the well bore shown in section, with the internal valve in the closed position.

The operation of the auto-cycling plunger 20 will now be described with reference to FIGS. 1 to 8. The plunger 20 is used in a well-bore 100 for lifting a fluid, such as oil or gas from the well and is therefore appropriately sized to fit in a well bore. With the valve stem 30 in the open position, the plunger 20 is oriented in the well bore 100 such that the spherical ball 36 is at the lowermost part of the plunger 20. The plunger 20 falls downwardly in the well bore 100 and gas and fluid is free to move through the continuous hollow body 22 and out the first end 38, as best shown in FIGS. 4 and 5. Fluid flow through the plunger 20 is indicated in FIG. 4.

When the plunger 20 reaches the bottom of the well bore 100, the spherical ball 36 strikes the bottom and pushes the valve stem 30 upwardly. As a result, the valve stem 30 shuttles from the open position into the closed position shown in FIG. 6. In this position, fluid can no longer flow through the plunger 20. As would occur to one of skill in the art, fluids migrate to the well and cause an increase in fluid pressure below the plunger 20 in the well bore 100. Each of the first directional outer seals 24, 26 form a seal between the body 22 and the well bore 100. As the pressure below the plunger 20 rises, the flange portions 28 of each of the first directional outer seals are pushed outwardly thus increasing the degree of sealing between the body 22 and the well bore 100.

It will be appreciated that the fluid above the plunger 20 imparts a downward pressure, known as head pressure. The flange portions 28 of each of the second directional outer seals 50, 52 are pushed outwardly thereby forming a seal between the body 22 and the well bore 100. Thus, the fluid below the plunger 20 is sealed from the fluid above the plunger 20. Also, head pressure increases the degree of sealing of the plunger and maintaining a seal in a multiple perforated well bore.

Figure 7:
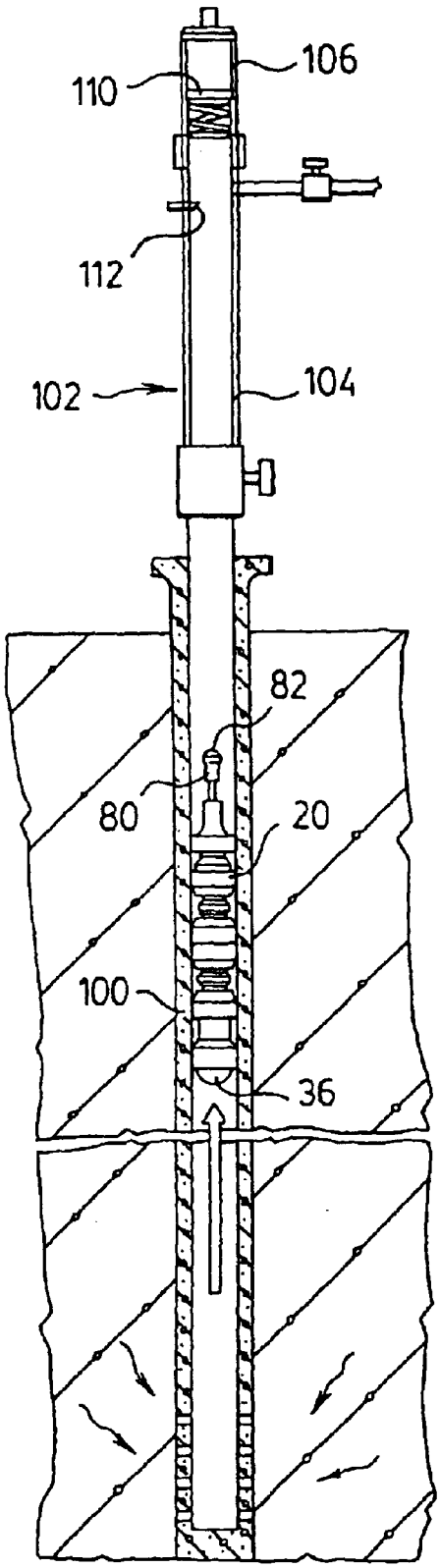
FIG. 7 is a side view of the auto-cycling plunger of FIG. 6 shown rising in the well bore shown in section.

As the pressure below the plunger 20 increases, the plunger is pushed upwardly in the well bore 100 thereby causing the fluid above the plunger 20 to rise, as shown in FIG. 7. The fluid above the plunger 20 is pushed out of the well bore 100 as the plunger 20 approaches the top of the well bore 100.

Figure 8:
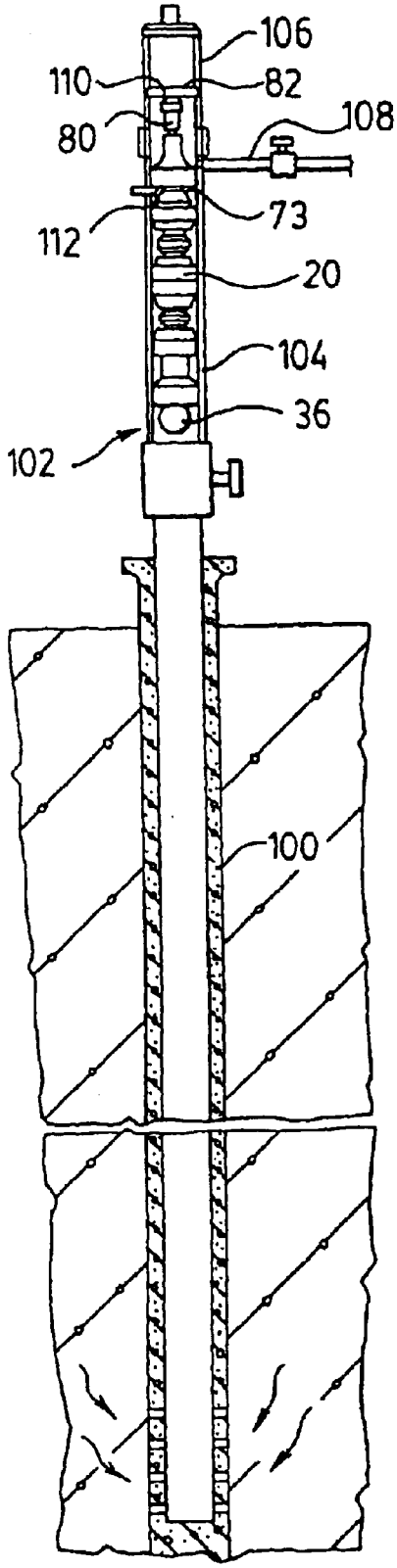
FIG. 8 is a side view of the auto-cycling plunger of FIG. 7 shown at a top of the well bore, with the internal valve in the open position.

Referring to FIGS. 7 and 8, the well head 102 is shown, in which a main barrel 104 is connected to and forms an extension of the well bore 100. The well head includes the main barrel 104 and a well cap 106. As the plunger rises, the fluid above the plunger 20 is pushed from the well head 102 and out an outflow line 108. The plunger 20 rises through the main barrel 104 and into a portion of the well cap 106. When the plunger reaches the well cap 106, the truncated tip 82 of the actuating head 80 strikes a striker plate 110 in the well cap 106. A spring is provided at the striker plate 110 to reduce impact speed of the plunger 20 with the striker plate 110. Upon striking the striker plate 110, the valve stem 30 shuttles from the closed position to the open position. Meanwhile, a spring-loaded catch 112 that is radially disposed in an upper portion of the main barrel 104 engages with the catch notch 73 of the plunger 20. The catch 112 maintains the plunger 20 in the well head 102.

The relative positions and dimensions of the catch 112 and the striker plate 110 are determined based on the plunger 20 dimensions. The truncated tip 82 of the plunger 20 strikes the striker plate 110 causing the valve stem 30 to shuttle to the open position. While in this position, the catch 112 is engaged in the catch notch 73. When the catch 112 is moved radially outwardly, thereby disengaging the catch notch 73, the plunger 20 is free to fall in the well bore again and repeat the cycle since fluid can again pass through the continuous hollow body 22.

It will be appreciated that the catch 112 is used to control the cycle time of the plunger 20. In other words, the plunger 20 can be held by the catch 112 in the well head 102 for any desired period of time. Also, the catch 112 can be automatically or manually controlled in order to control the cycling of the plunger 20.

If desired, the plunger 20 can be retrieved or pulled from the well bore 100 by pulling on the fish neck of the actuating head 80.

While the embodiments discussed herein are directed to particular implementations of the present invention, it will be apparent that variations and modifications to these embodiments are within the scope of the invention as defined solely by the claims appended hereto. For example, the size and shape of many of the elements of the pump can vary while still performing the same function.

What is claimed is:

1. An auto-cycling plunger for use in lifting a fluid out of a well bore, the auto-cycling plunger comprising:

a hollow, longitudinally extending body;

at least one first directional outer seal disposed on an exterior surface of said body for creating a seal between said body and a well bore and at least a portion of said at least one first directional outer seal extending in a direction substantially parallel to a length of said longitudinally extending body such that said portion of said first directional outer seal is spread resiliently outwardly from said body with an applied pressure, thereby increasing the degree of sealing;

at least one second directional outer seal disposed on the exterior surface of said body for creating a seal between said body and said well bore, at least a portion of said at least one second directional outer seal extending in a direction substantially parallel to said length of said longitudinally extending body and substantially opposite to the direction of said at least one first directional outer seal such that said portion of said second directional outer seal is spread resiliently outwardly from said body with a second applied pressure thereby increasing the degree of sealing; and a valve stem including a valve member, said valve stem extending through said longitudinally extending body and having actuable ends extending from said body, said valve stem operable to be shuttled between an open position and a closed position, whereby when said valve stem is in said open position, said valve member is longitudinally spaced from a valve seat on said body to allow fluid flow through the length of said body and when said valve stem is in said closed position, said valve member is seated on said valve seat, thereby sealing said body and preventing fluid flow therethrough.

2. The auto-cycling plunger according to claim 1 wherein said plunger includes two first directional outer seals.

3. The auto-cycling plunger according to claim 2 wherein said plunger includes two second directional outer seals.

4. The auto-cycling plunger according to claim 1 wherein said body comprises a first end and a second end attached to a tubular middle portion, said first end, said second end and said tubular middle portion forming a continuous hollow body for fluid flow therethrough when said valve stem is in said open position.

5. The auto-cycling plunger according to claim 4 wherein said at least one first directional outer seal and said at least one second directional outer seal are annularly disposed on said exterior surface of said tubular middle portion.

6. The auto-cycling plunger according to claim 5 wherein said valve member is a spherical ball coupled to said valve stem.

7. The auto-cycling plunger according to claim 6 wherein said valve seat is a semi-spherical recess at said second end of said body for receiving a portion of said spherical ball when said valve stem is in said closed position.

8. The auto-cycling plunger according to claim 1 wherein said valve stem and said body include a biased detent system releasable indexing of said valve stem in said open and closed positions in said body.

9. The auto-cycling plunger according to claim 8 wherein the biased detent system includes first and second longitudinally spaced annular grooves on said valve stem and said body includes a pair of inwardly biased protrusions biased into contact with said valve stem, said first annular groove for receiving said biased protrusions when said stem is in said open position, said second annular groove for receiving said biased protrusions when said stem is in said closed position.

10. The auto-cycling plunger according to claim 9 wherein each of said inwardly biased protrusions comprises a ball and a spring for biasing said ball into contact with said valve stem.

* * * * *